United States Patent [19]

Kassel et al.

[11] Patent Number: 5,064,344

[45] Date of Patent: Nov. 12, 1991

[54] PARTIAL THROAT DIFFUSER

[75] Inventors: John Kassel, Roscoe; Steve C. Remstad, Rockford, both of Ill.

[73] Assignee: Sundstrand Corporation, Rockford, Ill.

[21] Appl. No.: 430,013

[22] Filed: Nov. 1, 1989

[51] Int. Cl.[5] ..... F04D 29/44

[52] U.S. Cl. ..... 415/224.5; 415/208.3; 415/211.2; 415/914

[58] Field of Search ..... 415/208.1, 208.2, 208.3, 415/211.2, 224.5, 914

[56] References Cited

U.S. PATENT DOCUMENTS

| | | | |
|---|---|---|---|
| 1,998,784 | 4/1935 | Mock | 415/224.5 |
| 2,471,174 | 5/1949 | Trumpler | 415/224.5 |
| 3,010,642 | 11/1961 | Dickmann et al. | 415/224.5 |
| 3,289,921 | 12/1966 | Soo | 415/914 |
| 3,625,630 | 12/1971 | Soo | 415/224.5 |
| 3,658,437 | 4/1972 | Soo | 415/224.5 |
| 4,844,692 | 7/1989 | Minkkinen et al. | 415/208.1 |
| 4,888,417 | 12/1989 | Remstad et al. | 415/208.3 |

*Primary Examiner*—John T. Kwon

*Attorney, Agent, or Firm*—Harold A. Williamson

[57] ABSTRACT

A centrifugal fluid handling apparatus such as, for example, a centrifugal fuel pump for, for example, an aircraft engine, which includes a impeller rotatably mounted in a housing, with an annular diffuser ring being disposed about a periphery of the impeller. The annular diffuser ring includes at least one passage for discharging a fluid from the impeller, and a passive control is provided in a diffuser throat of the at least one passage at an entrance area thereof for providing a stabilized fluid discharge pressure through the at least one passage throughout an entire flow range of the fuel pump.

34 Claims, 4 Drawing Sheets

PARTIAL THROAT DIFFUSER

DESCRIPTION

1. Technical Field

The present invention relates to a fluid handling arrangement and, more particularly, to a partial throat diffuser means for a fluid handling arrangement such as, for example, a centrifugal fuel pump arrangement capable of exhibiting an extensive flow range while maintaining low fuel supply and high speed operation and also minimizing pump temperature increases and pressure instability.

2. Background Art

Fluid handling devices such as, for example, centrifugal pumps of various configurations have been proposed, with the proposed centrifugal pumps generally exhibiting a very low efficiency when the pumps are operated at low flow rates which are fractions of the maximum or design flow rate. Thus, when centrifugal pumps are employed in systems requiring variable flow rates and operating such systems at low flow rates, the centrifugal pumps generally waste considerable power, with the wasted power being dissipated, for the most part, as an increase in temperature of the fluid being pumped. As can readily be appreciated, in some systems, the increase in temperature may adversely affect the overall operation of the entire system.

For example, if the centrifugal pump is used as a fuel pump in aircraft, in normal use, high fuel flow rates are required in circumstances such as, for example, take-offs, climbing, or emergency situations requiring sudden increases in fuel supply. However, aircraft engines operated at flight idle descent, ground idle settings or taxiing may typically require only about a 1.5% to 3% of the flow rate required for high power operations. Thus, wasted power may cause the fuel to overheat resulting in possible interference with fuel flow, engine power control, and overall system reliability.

Additionally, a further problem with conventional centrifugal pumps resides in attempting to achieve a pressure stability during operation of the pump in a low flow region where pressure instability is typically encountered. This problem arises by virtue of the fact that the mechanism utilized in the pump for achieving minimum temperature rise at low flow rate and high speed operation yield a pump performance characteristic which can negatively interact with the fuel system resulting in unacceptable levels of pressure instability.

In, for example, U.S. Pat. No. 4,643,639, an adjustable centrifugal pump is proposed for efficient operation at low flow rates, with the pump seeking to avoid undue power consumption and heating of the fluid being pumped. In the proposed centrifugal pump, a radial or mixed flow impeller is rotatably mounted within the housing and an outlet volute extends about the impeller. First and second axially spaced diffusion passages establish a fluid communication between the impeller and the volute, with a valve being provided for closing one of the passages when low flow rates are demanded of the pump to minimize recirculation, leakage and churning losses consuming the power in leading to heating of the fluid.

While a number of other centrifugal pump arrangement have been proposed which are somewhat effective in improving the overall efficiency during less than maximum designed flow rates, such proposed pumps do not achieve a satisfactory level of pressure stability particularly at low flow region of the pump.

The above proposed fuel pumps achieve their objectives by using a variable geometry devices which require an actuator, an actuator control arrangement, and a positionable member controlled by the actuator. In these proposed constructions, the overall fuel pump system is complex by virtue of the necessity of a desired geometry signal from either an external source or from a hydraulic flow sensor which is contained within the pump assembly. Thus, in the proposed pumps, appropriate valving, mode of pressure source, passages for fluid power pressure routing, hydraulic cylinders and associated sealing and packings relative to the variable geometry device all add to significant complication to the overall pumping system which increases the chances of a possible malfunctioning of the system.

Centrifugal fluid handling arrangements and controls of the aforementioned type are proposed in, for example, U.S. Pat. Nos. 2,845,216, 3,236,500, 4,770,605, and 4,219,305, with each of these proposed constructions sharing a common disadvantage in that they require the implementation of relatively complex variable geometry features, variable admission devices, or a variable geometry vaneless diffuser arrangements in an attempt to provide improved efficiency for the centrifugal fluid handling arrangements.

SUMMARY OF THE INVENTION

The aim underlying the present invention essentially resides in providing a centrifugal fluid handling apparatus which is capable of achieving a more stable pressure characteristics during operation of the fluid handling apparatus.

Typically, in a centrifugal fluid handling apparatus rated pressure rise requirement is specified as a minimum value for an entire flow range of the apparatus such as, for example, 2% to 100% rated flow requirement.

In designing an apparatus with the pressure rise requirement in mind while also attempting to achieve maximum efficiency at low flow operating conditions, the fluid handling apparatus ends up delivering excess pressure in intermediate flow ranges while achieving the minimum pressure rise requirements at maximum and minimum rated flows. Unfortunately, unstable pressure rise performance resides with a positive slope of the pressure rise curve for low flow operating regions.

In accordance with advantageous features of the present invention, a centrifugal fluid handling arrangement such as, for example, a fuel pump for use in, for example, aircraft, is provided wherein a high pressure stability throughout an entire fuel flow range is achieved by virtue of a passive control of the flow of fuel through partial throat diffuser arrangement including a diffuser ring means annularly disposed about an outer periphery of an impeller means of the fuel pump, with a flow of fuel from the impeller means being passively controlled by a fixed geometrical relationship at an entrance area of the diffuser ring means.

The diffuser ring means is fashioned in accordance with the present invention in the form of a partial throat diffuser having a limited impact on a pressure rise of the pump at maximum and minimum flows where a pressure rise margin is limited and a more significant impact on a pressure rise for intermediate flow where a pressure rise margin is greater thereby resulting in a more stable pressure rise characteristic for the fluid handling apparatus.

In accordance with the present invention, the passive control may be achieved in, for example, a vaneless diffuser ring means, by, for example, providing for a fixed geometrical relationship at the inlet of the diffuser ring throat means thereby advantageously dispensing with the need for complicated control systems and/or actuators such as required in conventional centrifugal pump arrangements.

With a vaned diffuser ring means including one or more fluid discharging passage means or channels, the fixed geometrical relationship resulting in the passive control may, in accordance with the present invention, be achieved by disposing an inwardly directed shelf means in an entrance or inlet area of the at least one passage means formed in the diffuser ring means, with a vaneless space being defined between a downstream end of an impeller means, as viewed in a normal flow direction of the fuel, and the entrance or inlet area to the at least one passage means.

The shelf means may, in accordance with the present invention, be formed as a projection or protuberance extending radially inwardly so as to partially obstruct the inlet opening of the at least one passage means or at least some of a plurality of the passage means.

The projection or protuberance forming the shelf means, in accordance with the present invention is configured or proportioned such that the partial obstruction resulting by virtue of the presence of the projection or protuberance results in the permitting of a fuel flow sufficient to enable a fuel supply in a range of, for example, between 2% to 100% of a rated flow requirement and a high speed operation of up to, for example, 27,500 rpm while insuring a stabilized pressure throughout the entire operation range of the fuel pump.

In accordance with still further features of the present invention, the projection or protuberance forming the shelf means is dimensioned such that a total cross-section of the entrance areas of the passage means of the diffuser ring means are reduced by about 10% or greater up to 50%, and, preferably, by about 35% in order to achieve the desired fixed geometrical relationship.

In accordance with still further features of the present invention, the impeller means may include a front portion and a rear portion axially spaced from the front portion, with blade mean interposed between the front and rear portions. The front portion of the impeller means may extend radially beyond an outer periphery of the second portion and terminate in an outer peripheral portion disposed in opposition to the projection means.

The radially inwardly directed projection means may be fixedly provided on the diffuser ring means in the entrance area of at least one of the passage means of the diffuser ring means at a position axially spaced from an endface of the annular diffuser ring means facing an outer periphery of the impeller means, as viewed in a flow direction of fluid through the at least one passage means.

The radially inwardly directed projection means may be disposed at the axially spaced position from the endface of the annular diffuser ring either in an area of the front portion of the impeller means or in an area of the rear portion of the impeller means.

It is also possible in accordance with the present invention for the radially inwardly directed projection means to include a first projection extending axially radially inwardly of a portion of the diffuser ring means at a position in opposition to a front portion of the impeller means with a second projection extending radially inwardly of a portion of the diffuser ring means disposed in opposition to a rear portion of the impeller means, as viewed in a flow direction of the fluid.

The annular diffuser ring means may, in accordance with the present invention, terminate in an endface disposed in opposition to a front portion and rear portion of the impeller means, with a first projection and second projection forming the passive control means being axially spaced from the endface of the diffuser ring means, as viewed in a flow direction of fluid through the at least one passage means of the centrifugal fluid handling apparatus.

In accordance with still further features of the present invention, the radially inwardly directed projection means may be fashioned as an annular ring fixedly provided on the annular diffuser ring means in the entrance area of at least one passage means of the centrifugal fluid handling apparatus.

The annular ring may, in accordance with the present invention, be disposed on the annular diffuser ring means at a position spaced axially inwardly of the endface of the diffuser ring means, as viewed in a flow direction of fluid through the at least one passage means, or disposed at an endface of the annular diffuser ring means disposed in opposition to an outer periphery of the impeller means.

The annular diffuser ring means may be provided with a plurality of passage means, with only some of the passage means being provided with the passive control arrangement including the axially inwardly directed projection means.

The above and other objects, features, and advantages of the present invention will become more apparent from the following description when taken in connection with the accompanying drawing which show, for the purposes of illustration only, several embodiments in accordance with the present invention.

BEST MODE FOR CARRYING OUT THE INVENTION

Figure 1:
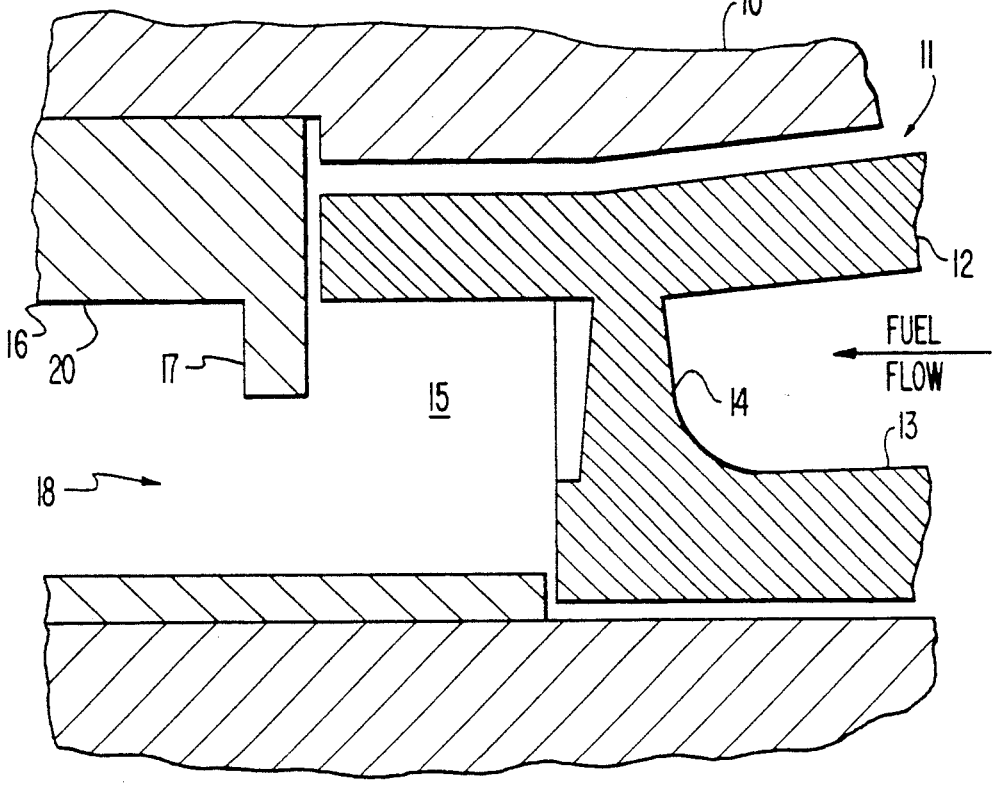
FIG. 1 is a cross-sectional detail view of a portion of an impeller and diffuser ring means of a centrifugal fluid handling apparatus construction in accordance with the present invention.

Referring now to the drawings wherein like reference numerals are used throughout the various views to designate like parts and, more particularly, to FIG. 1, according to this figure, a centrifugal fluid handling apparatus such as, for example, a fuel pump, generally employed, for example, in an aircraft engine, includes a housing 10 having mounted therein, in a conventional manner, an impeller means generally designated by the reference numeral 11. The impeller means 11 may, for example, be fashioned as a shrouded impeller 11 including a front shroud 12, rear shroud 13, and a plurality of blades 14 arranged about the impeller means, in a conventional manner, with the front shroud 12 radially outwardly projecting beyond on outer periphery of the rear shroud 13; however, as can readily be appreciated the principles of the present invention are equally applicable to any other impeller configuration typically employed in a centrifugal fluid handling apparatus.

An annular diffuser ring 16 is disposed about a periphery of the impeller means 11 and includes a diffuser throat portion generally designated by the reference numeral 18, with the annular diffuser ring 16 being provided, in a conventional manner, with a plurality of circumferentially spaced passages or channels 20, only one of which is illustrated in the drawings for the sake of clarity. Each of the passages 20 may, for example, have a generally quadrangular, circular, conical or other suitable cross-sectional configuration, with the number of passages 20 provided in the annular diffuser ring 16 varying in dependence upon a particular application of the centrifugal pump; however, as an example, the centrifugal pump may be provided with seven passages 20 for discharging fuel from the impeller means 11 of the centrifugal pump through the throat portion 18 of the annular diffuser ring 16. The annular diffuser ring 16 terminates in an endface 16' disposed in opposition to the outer periphery of the impeller means 11, and defines, with the impeller means 11, a vaneless space 15. While the annular diffuser ring 16 has been illustrated as being a vaned diffuser ring, it is understood that the principle of the present invention and equally applicable to a vaneless diffuser ring means with the inlet throat or entrance area thereof being controlled in the manner described more fully hereinbelow.

A radially inwardly directed shelf or projection 17 is provided at an entrance area of at least some of the passages 20 of the annular diffuser ring 16 so as to reduce the cross-sectional area of each of the entrance areas of the passages 20, and, for example, with an annular diffuser ring 16 provided with seven passages 20, the axially inwardly directed shelf or projection 17 may be provided at entrance areas of, for example, five of the seven passages. The shelf or projection 17 is dimensioned in such a manner that the total cross-section of the entrance areas of the passages 20 provided with the shelf or projection 17 are reduced by about 35% as compared with the total cross-sectional area of the passage means downstream of the shelf or projection 17 thereby resulting in a significant improvement in the discharge pressure stability of the fuel pump without any deleterious effect on the pressure rise of the pump at low, intermediate and maximum rated flow of the pump.

Figure 2:
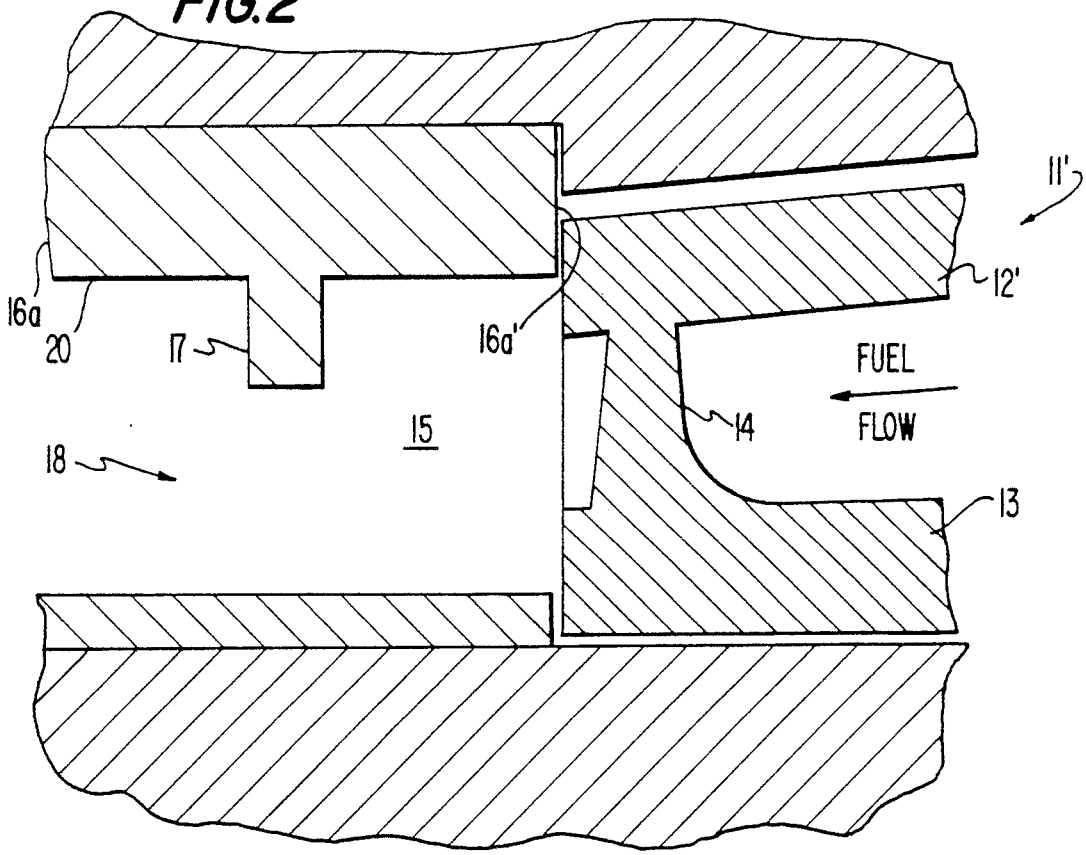
FIG. 2 is a cross-sectional detail view of a portion of an impeller and diffuser ring means of a centrifugal fluid handling apparatus constructed in accordance with another embodiment of the present invention.

As shown in FIG. 2, a centrifugal pump may include a impeller means generally designated by the reference numeral 11' including a front shroud 12', rear shroud 13 and plurality of blades 14, with an annular diffuser ring **16*a* provided with a plurality of circumferentially spaced passages 20. The shelf or projection 17 is provided on the annular diffuser ring 16*a* at a position spaced axially inwardly from the endface 16*a'* of the annular diffuser ring 16*a*, as viewed in a direction of flow of fluid from the impeller means 11'. The shelf or projection 17, portion of the annular diffuser ring 16*a* and outer periphery of the impeller means 11' define the vaneless space 15. In all other respects, the pump of FIG. 2 corresponds to the pump described hereinabove in connection with FIG. 1**.

Figure 3:
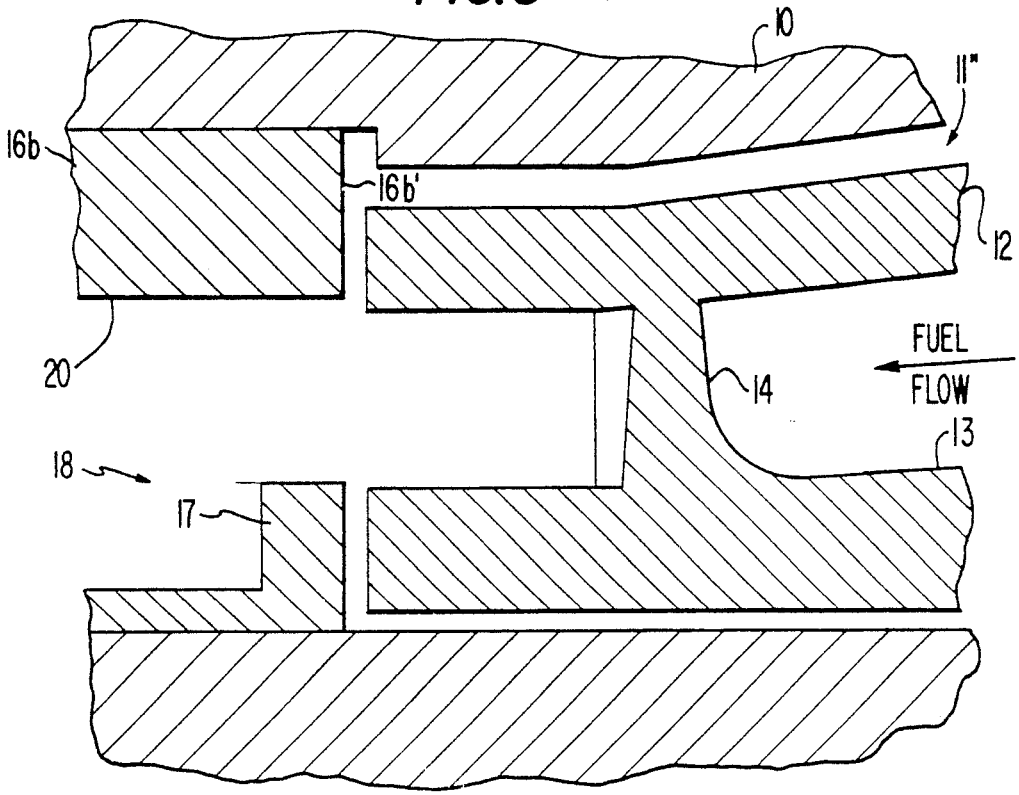
FIG. 3 is a cross-sectional detail view of a portion of an impeller and diffuser ring means of a centrifugal fluid handling apparatus constructed in accordance with yet another embodiment of the present invention.

As shown in FIG. 3, in accordance with the present invention, the pump may include a impeller means 11'' including a front shroud 12 and a rear shroud 13', with an annular diffuser ring **16*b* being disposed about a periphery of the impeller means 11'' and including a plurality of discharge passages 20. The annular diffuser ring 16*b* terminates in an endface 16*b'* disposed in opposition to the outer periphery of the impeller means 11''. In FIG. 3, the radially inwardly directed shelf or projection 17 is provided at the entrance area of at least some of the passages 20 at the endface 16*b* at a position disposed in opposition to the outer periphery of the rear shroud 13' of the impeller means 11''**.

Figure 4:
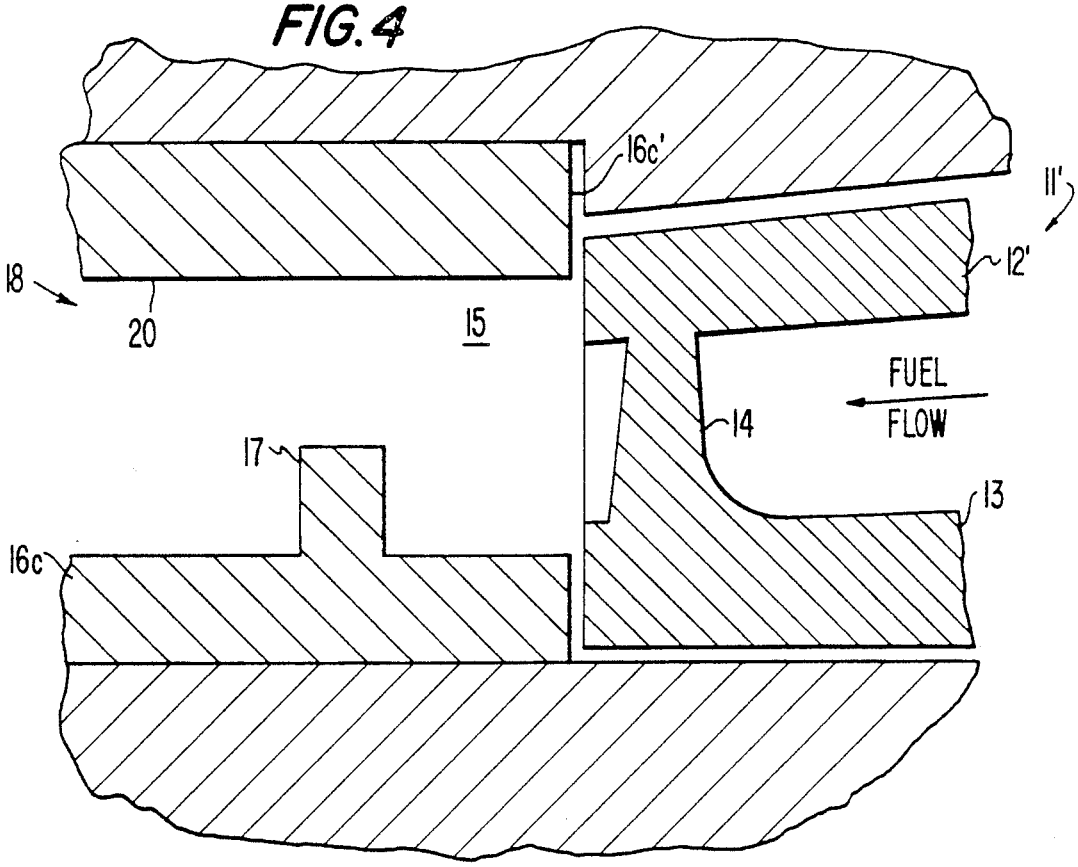
FIG. 4 is a cross-sectional detail view of a portion of an impeller and diffuser ring means of a centrifugal fluid handling apparatus constructed in accordance with a still further embodiment of the present invention.

It is also possible, as shown most clearly in FIG. 4, to provide an annular diffuser ring **16*c* about a periphery of the impeller means 11', with the radially inwardly directed shelf or projection 17 provided at some of the radially passages 20 at a position spaced axially inwardly of an endface 16*c'* of the annular diffuser ring 16*c* in the same manner as described hereinabove in connection with FIG. 2, but with the shelf or projection 17 being disposed in an area of the rear shroud 13 of the impeller means 11'**.

Figure 5:
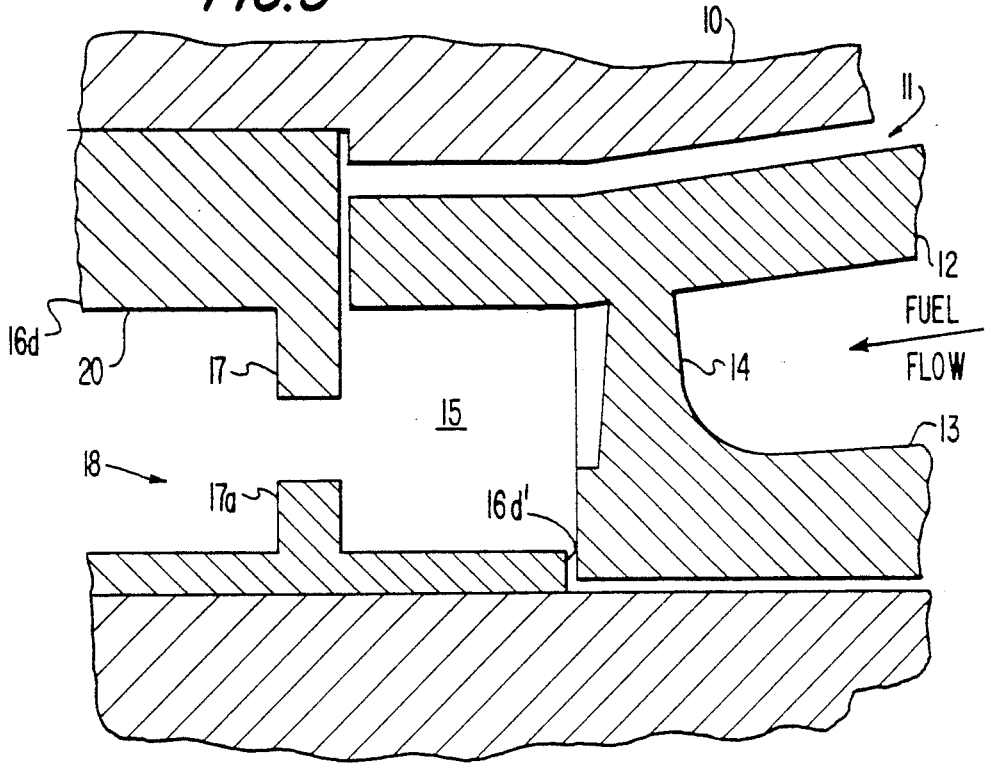
FIG. 5 is a cross-sectional detail view of a portion of an impeller and diffuser ring means of a centrifugal fluid handling apparatus constructed in accordance with another embodiment of the present invention.
Figure 6:
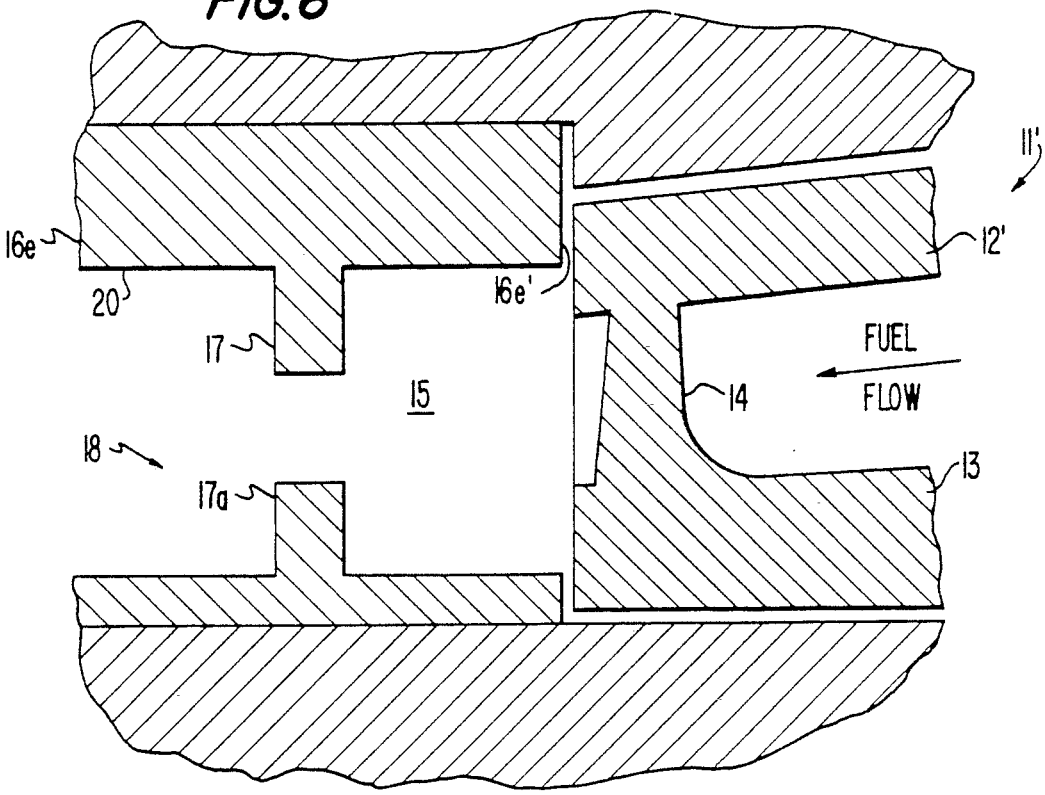
FIG. 6 is a cross-sectional detail view of a portion of an impeller and diffuser ring means of a centrifugal fluid handling apparatus constructed in accordance with another embodiment of the present invention.

As shown in FIGS. 5 and 6, according to the present invention, a pair of opposed shelf or projections 17, **17*a* may be provided at the entrance areas of at least some of the passages 20 of an annular diffuser ring 16*d* or 16*e*, with the projection 17*a* in FIG. 5 being radially axially spaced from an endface 16*d'* of the annular diffuser ring 16*d* or, as shown in FIG. 6, both projections 17, 17*a* may be radially axially spaced from the endface 16*e'* of the annular diffuser ring 16*e*, as viewed in a flow direction of fluid through the passages 20**.

In FIGS. 5 and 6, the shelf or projections 17, **17*a* may be fashioned as two individual members provided on the annular diffuser ring 16*d* or 16*e*; however, it is also possible for the shelf or projection to be formed as an annular shelf or projection on the respective diffuser rings 16*d*, 16*e* and dimensioned such that the entrance areas of the passages 20** provided with the shelf or projection are reduced by about 35% as compared with cross-sectional areas of the passages downstream of the annular rings.

Figure 7:
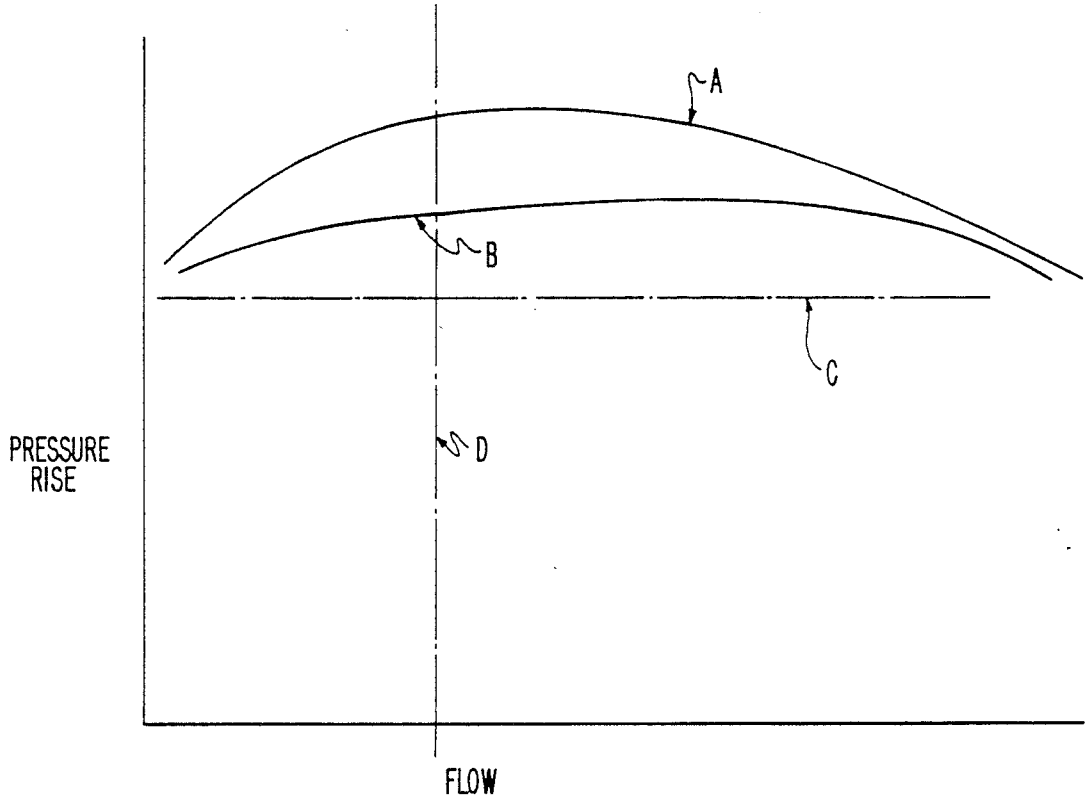
FIG. 7 is a graphical illustration of pressure rise versus flow of a conventional fluid handling arrangement in comparison with a fluid handling arrangement constructed in accordance with the present invention.

FIG. 7 provides a graphical illustration of the meritorious effects of the present invention when viewing flow versus pressure rise in a centrifugal pump, with the performance of the present invention being represented by a curve designated by the reference character B and the conventional centrifugal pump being represented by the curve designated by the reference character A.

In FIG. 7, the line designated by the reference character C represents a minimum required pressure rise performance of a centrifugal pump, with the line designated by the reference character D representing a point in the flow separating typical stable and unstable performance or the centrifugal pump. An area to the left of the line D in FIG. 7 represents a typical unstable performance region and an area to the right of line D in FIG. 7 representing a typically stable performance.

As shown in FIG. 7, by virtue of the provision of the shelf or projection 17 at the entrance areas of the respective passages 20, the centrifugal pump exhibits a flatter or more stable pressure rise curve, with the flatter curve representing a reduction in pressure rise throughout the entire flow range of the pump. By virtue of the features of the present invention, the pressure and stability inception point is either completely eliminated or moved to an extremely low flow condition of the pump.

As readily apparent, the impeller may have other configurations and, for example, the impeller may be provided with a rear shroud extending beyond an outer periphery of the front shroud, with the shelf or projection 17 being arranged in a manner similar to FIGS. 1–4, namely, with the shelf or projection disposed at an end face of the annular diffuser ring or axially spaced from the endface, as viewed in a flow direction of the fluid, in opposition to either the outer periphery of either the front or rear shroud. Additionally, with the rear shroud of the impeller extending beyond the outer periphery of the front shroud, it is also possible to provide either individual shelfs of projections 17, 17*a* in a manner similar to FIGS. 5 and 6, or to provide an annular ring in lieu of the shelf or projections 17, 17*a*. Likewise, the impeller 11′ may be employed, with the shelf or projection 17 being disposed at a position such as illustrated in FIG. 12, or the impeller 11″ may be employed with the shelf or projection positioned as illustrated in FIG. 1. Thus, it is understood that the nature or configuration of the impeller may vary considerably in dependence upon a given application of the centrifugal fluid handling apparatus, with the technique of the present invention being equally applicable to various impeller structures With the shelf or projection positioned in the manner described hereinabove it is possible to provide a centrifugal pump having a fixed geometry arrangement at each entrance area of at least some of the passages 20 of the annular diffuser ring 16 which permits a sufficient fuel supply in a flow range of, for example, 2% to 100% of the rated flow rate at a high operational speed of up to, for example, 27,500 rpm while insuring a stabilized fuel pressure throughout the entire flow range of the pump.

Additionally, the provision of a fixed geometrical relationship in the entrance or inlet area of a vaneless passive control arrangement is obtained thereby dispensing with the need for complicated constructions and/or control means generally employed in conventional centrifugal pumps for achieving a variable geometric control of the cross-sectional areas of the passages normally provided in a diffuser ring of a centrifugal fluid handling devices such as a centrifugal pump.

While we have shown and described several embodiments in accordance with the present invention, it is understood that the same is not limited thereto but is susceptible to numerous changes and modifications as known to one of ordinary skill in the art, and we therefore do not wish to be limited to the details shown and described herein but intend to cover all such modifications as are encompassed by the scope of the appended claims.

We claim:

1. A centrifugal fluid handling apparatus comprising a housing means, an impeller means rotatably mounted in said housing means, an annular diffuser ring means disposed around a periphery of the impeller means, at least one passage means provided in the annular diffuser ring means for discharging a fluid at subsonic flow velocity from the impeller means and passive control means provided in a diffuser throat means of the at least one passage means at an entrance area of the at least one passage means for preventing an instability of fluid discharge pressure through the at least one passage means under low flow operating conditions of the fluid handling apparatus, wherein said passive control means includes radially inwardly directed projection means for reducing a cross-sectional area of the entrance area of the at least one passage means, said radially inwardly directed projection means being fixedly provided at an endface of the annular diffuser ring means disposed in opposition to an outer periphery of the impeller means, wherein said radially inwardly directed projection means defines a vaneless space with the outer periphery of the impeller means for receiving fluid from the impeller means.

2. A centrifugal fluid handling apparatus according to claim 1, wherein said radially inwardly directed projection means reduces the entrance area of the at least one passage means by about 10–50% of a cross-sectional area thereof.

3. A centrifugal fluid handling apparatus according to claim 2, wherein said radially inwardly directly projection means reduces the entrance area of the at least one passage means by about 35% of the cross-sectional area thereof.

4. A centrifugal fluid handling apparatus according to claim 1, wherein said impeller means includes a front portion and a rear portion axially spaced from said front portion, and blade means interposed between said front portion and said rear portion, and wherein said front portion of said impeller means extends radially beyond an outer periphery of said second portion and terminates in an outer peripheral portion disposed in opposition to said radially inwardly directed projection means.

5. A centrifugal fluid handling apparatus according to claim 1, wherein said passive control means includes radially inwardly directed projection means for reducing a cross-sectional area of the entrance area of the at least one passage means, said radially inwardly directed projecting means being fixedly provided on the annular diffuser ring means in the entrance area of the at least one passage means at a position axially spaced from an endface of the annular diffuser ring means facing an outer periphery of the impeller means, as viewed in a flow direction of fluid through said at least one passage means.

6. A centrifugal fluid handling apparatus according to claim 5, wherein the impeller means includes a front portion and a rear portion axially spaced from said front portion, and wherein said radially inwardly directed projection means is provided on the annular diffuser ring means at a portion thereof disposed in opposition to the front portion of the impeller means.

7. A centrifugal fluid handling apparatus according to claim 1, wherein said passive control means includes radially inwardly directed projection means for reducing a cross-sectional area of the entrance area of the at least one passage means, said radially inwardly directed projection means being fixedly provided on the annular diffuser ring means in the entrance area of the at least one passage means at an endface of the annular diffuser ring means disposed in opposition to an outer periphery of the impeller means at a rear portion of the impeller means, as viewed in a flow direction of the fluid.

8. A centrifugal fluid handling apparatus according to claim 1, wherein said passive control means includes radially inwardly directed projection means for reducing a cross-sectional area of the at least one passage means, said radially inwardly directed projection means being fixedly provided on the annular diffuser ring means in the entrance area of the at least one passage means at a position spaced from an endface of the annular diffuser ring means facing an outer periphery of the impeller means, as viewed in a flow direction of the fluid through the at least one passage means, and at a rear portion of the impeller means.

9. A centrifugal fluid handling apparatus according to claim 1, wherein said passive control means includes radially inwardly directed projection means for reducing a cross-sectional area of the entrance area of the at least one passage means, said radially inwardly directed projection means being fixedly provided on the annular diffuser ring means in the entrance area of the at least one passage means, said radially inwardly directed projection means including a first projection extending radially inwardly of a portion of the annular diffuser ring means disposed in opposition to a front portion of the impeller means and a second projection extending radially inwardly of a portion of the annular diffuser ring means disposed in opposition to a rear portion of the impeller means, as viewed in a flow direction of the fluid.

10. A centrifugal fluid handling apparatus according to claim 9, wherein the front portion of the impeller means extends beyond an outer periphery of the rear portion of the impeller means and terminates at a first endface of the annular diffuser ring means.

11. A centrifugal fluid handling apparatus according to claim 9, wherein the annular diffuser ring means terminates in an endface disposed in opposition to the front portion and rear portion of the impeller means, and wherein said first projection and second projection are axially spaced from said endface, as viewed in a flow direction of fluid through said at least one passage means.

12. A centrifugal fluid handling apparatus according to claim 1, wherein said passive control means includes radially inwardly directed projection means for reducing a cross-sectional area of the at least one passage means, said radially inwardly directed projection means being fashioned as an annular ring fixedly provided on the annular diffuser ring means in the entrance area of the at least one passage means.

13. A centrifugal fluid handling apparatus according to claim 12, wherein said annular diffuser ring means terminates in an endface disposed in opposition to an outer periphery of said impeller means, and wherein said annular ring is disposed on said annular diffuser ring means at a position spaced axially inwardly of the endface, as viewed in a flow direction of fluid through the at least one passage means.

14. A centrifugal fluid handling apparatus according to claim 12, wherein said impeller means includes a front portion and a rear portion axially spaced from said front portion, said front portion extends beyond an outer periphery of said rear portion, said annular diffuser ring means includes at least one endface disposed in opposition to an outer periphery of the front portion of the impeller means, and wherein said annular ring is disposed at said endface of said annular diffuser ring means.

15. A centrifugal fluid handling apparatus comprising a housing means, an impeller means rotatably mounted in said housing means, an annular diffuser ring means disposed around a periphery of the impeller means, a plurality of passage means provided in the annular diffuser ring means, for discharging a fluid from the impeller means, and passive control means provided in a diffuser throat means at entrance areas of only some of said plurality of passage means for providing a stabilized fluid discharge pressure through said some of said plurality of passage means through an entire flow range of the fluid handling apparatus, wherein said passive control means reduces a total cross-sectional area of the entrance areas of said some of plurality of passage means, wherein said passive control means includes radially inwardly directed projection means fixedly provided on the annular diffuser ring means in each of the entrance areas of said some of plurality of passage means, wherein said radially inwardly directed projection means define a vaneless space with an outer periphery of said impeller means.

16. A centrifugal fluid handling apparatus according to claim 15, wherein the total cross-sectional area is reduced by about 10–50% of the total cross-sectional area of said some of said plurality of passage means.

17. A centrifugal fluid handling apparatus according to claim 16, wherein the total cross-sectional area is reduced by about 35%.

18. A centrifugal fluid handling apparatus according to claim 15, wherein said impeller means includes a front portion, a rear portion axially spaced from said front portion, blade means interposed between said front portion and said rear portion, and wherein said front portion of said impeller means extends beyond an outer periphery of said rear portion and terminates in an outer peripheral portion disposed in opposition to the radially inwardly directed projection means in each of the entrance areas of said some of said plurality of passage means.

19. A centrifugal fluid handling apparatus according to claim 15, wherein the radially inwardly directed projection means provided at each of the entrance areas of said some of said plurality of passage means are disposed at an endface of the diffuser ring means disposed in opposition to an outer periphery of the impeller means at a rear portion of the impeller means, as viewed in a flow direction of fluid through said some of said plurality of passage means.

20. A centrifugal fluid handling apparatus according to claim 15, wherein said passive control means includes radially inwardly directed projection means for reducing a cross-sectional area of each of said some of said plurality of passage means, said radially inwardly directed projection means being fixedly provided on the diffuser ring means in each of the entrance areas of said some of said plurality of passage means at a position spaced from an endface of the annular diffuser ring means facing an outer periphery of the impeller means, as viewed in a flow direction of fluid through said some of said plurality of passage means, at a rear portion of the impeller means.

21. A centrifugal fluid handling apparatus according to claim 15, wherein said passive control means includes radially inwardly directed projection means for reducing a cross-sectional area of each of the entrance areas of said some of said plurality of passage means, said projection means including a first projection extending radially inwardly of a portion of the diffuser ring means disposed in opposition to a front portion of the impeller means and a second portion extending radially inwardly of a portion of the diffuser ring means disposed in opposition to a rear portion of the impeller means.

22. A centrifugal fluid handling apparatus according to claim 21, wherein the front portion of the impeller means extends beyond an outer periphery of the rear portion of the impeller means and terminates at a first endface of the annular diffuser ring means.

23. A centrifugal fluid handling apparatus according to claim 21, wherein the annular diffuser ring means terminates in an endface disposed in opposition to the front portion and a rear portion of the impeller means, and wherein said first projection and said second projection are axially spaced from said endface, as viewed in a flow direction of fluid through said at least some of said plurality of passage means.

24. A centrifugal fluid handling apparatus according to claim 17, wherein said passive control means includes radially inwardly directed projection means for reducing a cross-sectional area of said some of said plurality of passage means, said radially inwardly directed projection means being fashioned as an annular ring fixedly provided on the annular diffuser ring means in each of the entrance areas of said some of said plurality of passage means.

25. A centrifugal fluid handling apparatus according to claim 24, wherein said annular diffuser ring means terminates in an endface disposed in opposition to the outer periphery of said impeller means, and wherein said annular ring is disposed on said annular diffuser ring means at a position spaced axially inwardly of the endface, as viewed in a flow direction of fluid through said some of said plurality of passage means.

26. A centrifugal fluid handling apparatus according to claim 24, wherein said impeller means includes a front portion and a rear portion axially spaced from said front portion, said front portion extends beyond an outer periphery of said rear portion, said annular diffuser ring means includes at least one endface disposed in opposition to-an outer periphery of the front portion of the impeller means, and wherein said annular ring is disposed at said endface of said annular diffuser ring means.

27. A centrifugal fluid handling apparatus according to claim 15, wherein the radially inwardly directed projection means provided in each entrance area of said some of plurality of passage means are arranged at a position axially spaced from an endface of the annular diffuser ring means facing an outer periphery of the impeller means, as viewed in a flow direction through said some of said plurality of passage means.

28. A centrifugal fluid handling apparatus according to claim 27, wherein the impeller means includes a front portion and a rear portion axially spaced from said front portion, and wherein said radially inwardly directed projection means provided at the entrance areas of said some of said plurality of passage means are provided on the diffuser ring means at a portion thereof disposed in opposition to the front portion of the impeller means.

29. A centrifugal fluid handling apparatus according to claim 15, wherein the fluid handling apparatus is a centrifugal fuel pump.

30. A centrifugal fluid handling apparatus according to claim 29, wherein said impeller means is a shrouded impeller.

31. A centrifugal fluid handling apparatus according to claim 30, wherein said passive control means includes radially inwardly directed projection means provided at each entrance area of said some of said plurality of passage means for reducing a cross-sectional area of each of said entrance ways by a predetermined amount so as to ensure a stabilized fluid discharge pressure under said low flow operating conditions of the fluid handling apparatus.

32. A centrifugal fluid handling apparatus according to claim 31, wherein said predetermined amount is in a range of 10 to 50% of a total of the cross-sectional areas of said entrance areas of said some of said plurality of passage means.

33. A centrifugal fluid handling apparatus according to claim 32, wherein said predetermined amount is about 35%.

34. A centrifugal fluid handling apparatus according to claim 30, wherein said passive control means includes a radially inwardly directed projection means in the form of an annular ring provided on said annular diffuser ring means in each of the entrance areas of said some of said plurality of passage means.

* * * * *